US005178994A

United States Patent [19]

Yamada

[11] Patent Number: 5,178,994

[45] Date of Patent: Jan. 12, 1993

[54] PROCESSING OF PHOTOGRAPHIC SILVER HALIDE PHOTOSENSITIVE MATERIAL IN REDUCED REPLENISHMENT MODE

[75] Inventor: Minoru Yamada, Kanagawa, Japan

[73] Assignee: Fuji Photo Film Co., Ltd., Kanagawa, Japan

[21] Appl. No.: 718,515

[22] Filed: Jun. 21, 1991

[30] Foreign Application Priority Data

Jun. 22, 1990 [JP] Japan ..... 2-164760

[51] Int. Cl.[5] ..... G03C 5/24

[52] U.S. Cl. ..... 430/419; 430/393; 430/418; 430/434; 430/456

[58] Field of Search ..... 430/393, 434, 418, 419, 430/456, 458, 465, 466, 491, 966

[56] References Cited

U.S. PATENT DOCUMENTS 4,826,757 5/1989 Yamada et al. ..... 430/966

*Primary Examiner*—Hoa Van Le

*Attorney, Agent, or Firm*—Sughrue Mion Zinn Macpeak & Seas

[57] ABSTRACT

Photographic silver halide photosensitive material is continuously processed through an automatic processor by passing the photosensitive material through a developing tank filled with a developer and then through a fixing tank filled with a fixer while supplying developer and fixer replenishers to the developing and fixing tanks in amounts corresponding to the processing quantity. The replenisher amount can be reduced by adding a chelating agent to the developer and its replenisher. Kits containing developer and fixer replenisher concentrates become empty at the same timing if the ratio of the volumes of developer and fixer replenishers prepared from their kits by diluting developer and fixer concentrates in the kits with water is substantially equal to the ratio of the amounts of developer and fixer replenishers supplied to the tanks.

9 Claims, No Drawings

PROCESSING OF PHOTOGRAPHIC SILVER HALIDE PHOTOSENSITIVE MATERIAL IN REDUCED REPLENISHMENT MODE

This invention relates to a method for processing a photographic silver halide photosensitive material (often referred to simply as photosensitive material) in a reduced replenishment mode.

BACKGROUND OF THE INVENTION

Black-and-white photosensitive materials after exposure are processed through a series of steps of development, fixation, washing and the like. These steps are generally carried out in an automatic processor having a series of processing tanks filled with a developer, fixer and other processing solutions by successively conveying a length of photosensitive material through the tanks.

To maintain the processing ability of processing solution in a processor tank constant, such continuous processing often relies on the replenishment mode wherein a replenisher for the processing solution is made up in an amount corresponding to the quantity of photosensitive material processed. In the case of X-ray photosensitive material, for example, the processing solution replenisher is prepared by furnishing a replenisher reservoir having a replenisher concentrate received therein, introducing a predetermined amount of the replenisher concentrate into a stock tank, and adding a predetermined amount of water thereto for dilution.

More particularly, for developers, their replenisher concentrate is available in a one, two or three-part system, each part being received in an individual reservoir. In a system having two or more parts, reservoirs containing the parts are usually combined into an integral reservoir assembly. Similarly for fixers, their replenisher concentrate is available as a one or two-part system, each part being received in an individual reservoir.

At present, environmental maintenance and resource saving are generally the most important requirements in the industry. It is desired to reduce the amount of processing solution and water used. In such situations, as to the processing of photosensitive material in the replenishment mode, it is also desired to reduce the replenishment amount. In practice, the technology tends toward a decreasing replenishment amount.

A reduced replenishment amount will result in a reduced frequency of replacement of a replenisher reservoir. Irrespective of the advantage that the frequency of a replenisher reservoir becoming empty is reduced, replacement of new replenisher reservoirs is rather complicated since the cycle of reservoirs becoming empty varies between a developer and a fixer. There can occur an accident that one reservoir has been replaced, but the other reservoir is left unchanged.

SUMMARY OF THE INVENTION

Therefore, an object of the present invention is to provide a method for continuously processing a photographic silver halide photosensitive material in a replenishment mode, especially in a reduced replenishment mode which facilitates the preparation and replenishment of processing solutions.

The present invention is directed to a method for processing a photographic silver halide photosensitive material through an automatic processor having a developing tank filled with a developer and a fixing tank filled with a fixer. The photosensitive material is passed through the developing tank for development and then through the fixing tank for fixation, while developer and fixer replenishers are supplied to the developing and fixing tanks in amounts corresponding to the quantity of the photosensitive material processed, respectively.

According to the feature of the present invention, a chelating agent is added to the developer and its replenisher for the purposes of collecting iron. There is furnished a developing package unit having received therein a developing replenisher concentrate, from which the developer replenisher is prepared by diluting the replenisher concentrate in the developing package unit with water to a total volume of Pd ml. There is also furnished a fixing package unit having received therein a fixing replenisher concentrate, from which the fixer replenisher is prepared by diluting the replenisher concentrate in the fixing package unit with water to a total volume of Pf ml. The developer replenisher is supplied in an amount of (Rep)d ml per unit area (1 $m^2$) of the photosensitive material, and the fixer replenisher supplied in an amount of (Rep)f ml per unit area (1 $m^2$) of the photosensitive material. The fixer and developer replenishers are adjusted in the preparation and supply steps such that (Rep)d is up to 450 ml, (Rep)f is up to 500 ml, and the fixer to developer replenishment ratio (Rep)f/(Rep)d is substantially equal to Pf/Pd and falls within the range of from 0.7 to 1.5. Preferably, Tf/Td is substantially equal to Pf/Pd, provided that the developer in the developing tank has a volume of Td ml and the fixer in the fixing tank has a volume of Tf ml.

According to the present invention, photosensitive material is subjected to development and fixation in a running mode while replenishing the developer and the fixer in amounts corresponding to the quantity of photosensitive material processed. In running equilibrium state, the developer contains iron, one of heavy metals deriving from water, chemical processing agents or photosensitive material in an amount of about 0.05 to about 10 ppm calculated as Fe. Undesirably, the developer having iron dissolved therein is less stable. Then, the present invention overcomes this problem by adding 0.01 to 50 grams of a chelating agent per liter of the developer for the purposes of collecting the dissolved iron.

It should be understood that in a developer at pH 11 or lower, iron constitutes a factor of determining the rate of deterioration of the developer (rate-determining factor). Certain chelating agents like ethylenediaminetetraacetic acid and its salts permit iron ions to act in a catalytic manner to markedly promote the deterioration of the developer. Therefore, when the developer has a pH value of 11 or lower, a choice of the chelating agent is critical. In turn, for developers in excess of pH 11, any desired chelating agent may be used because iron does not constitute a rate-determining factor with respect to deterioration of the developer at such higher pH levels.

Since the stability of the developer is insured in this way, it becomes possible to reduce the amount of developer replenished, specifically to 450 ml or less per square meter of photosensitive material processed. Similarly, the amount of fixer replenished can be reduced to 500 ml or less per square meter of photosensitive material processed.

For such reduced replenishment mode processing, the amounts of diluting water and a replenisher concentrate received in a replenisher reservoir as a package unit are reduced in proportion to a reduction in replenishing amount of each of the developer and fixer. The present invention adjust these factors to meet the following relationship.

$$(Rep)f/(Rep)d = Pf/Pd \simeq 0.7 \text{ to } 1.5$$

For example, if replenishment is started from the point of time when a new set of replenisher reservoirs are installed for both the developing and fixing tanks, then the process control of the present invention allows the replenisher reservoirs to be replaced at the same intervals from then on. The concurrent replacement of two replenisher reservoirs is more convenient than separate replacement.

The control method of the present invention is advantageous particularly when a processing span which takes more than one day until the total volume of processing solution in a processing tank is replaced by its replenisher is continuously repeated for a long period of time. In such a process, the replenisher reservoirs are usually replaced every 3 to 7 days. If the timing of replenisher reservoirs becoming empty is off, the operator might forget to replace one replenisher reservoir.

In the present method, as tank solutions for the developer and fixer are prepared from the corresponding replenisher concentrates in the reservoirs of respective package units, the amounts of the replenisher concentrates in the respective reservoirs are reduced in proportion to the necessary tank volume. The relationship:

$$Td/Tf \simeq Pd/Pf$$

ensures that if the volumes of the replenisher concentrates (usually the reservoir volumes) are determined such that the replenisher concentrates in respective reservoirs are entirely consumed to prepare the tank solutions, then both the replenisher reservoirs become empty simultaneously at the tank solution preparing stage. This allows the replenisher reservoirs to be replaced at the same timing. Then on the start of replenishment, both the replenisher concentrates in respective package units can be used from the same start line in preparing replenishers.

The replacement timing is coincident even when the replenisher concentrates in respective reservoirs are not entirely consumed in preparing the tank solutions. Since the ratio of the amounts of replenisher concentrate to diluting water is often identical between the tank solution and its replenisher, the package unit for preparing a tank solution may have the same construction as the package unit for preparing a replenisher. Then the replenisher concentrates remaining in the reservoirs after the tank solutions have been prepared may be directly used to prepare the replenishers and thereafter, both the reservoirs become empty at the same timing.

DETAILED DESCRIPTION OF THE INVENTION

According to the present invention, photographic silver halide photosensitive material is processed with processing solutions through an automatic processor while replenishing the processing solutions in amounts in proportion to the quantity of photosensitive material processed.

The process includes steps of development and fixation. The developer is replenished in an amount of up to 450 ml, preferably 100 to 350 ml per square meter of photosensitive material processed. Similarly, the fixer is replenished in an amount of up to 500 ml, preferably 100 to 400 ml per square meter of photosensitive material processed. In this sense, the present invention employs a reduced replenishment mode.

A replenisher for the developer and a replenisher for the fixer are prepared by diluting the corresponding replenisher concentrates with water. These replenisher concentrates are received in developing and fixing package units or kits, respectively. The units usually take the form of reservoirs.

For the developer, provided that the developing replenisher concentrate in the reservoir has a volume of P1d ml and diluting water used in diluting this volume of replenisher concentrate to prepare a replenisher has a volume of P2d ml, the volume of the developer replenisher prepared from the developing package unit, Pd ml, is given as Pd=P1d+P2d (in ml).

Also for the fixer, provided that the fixing replenisher concentrate in the reservoir has a volume of P1f ml and diluting water used in diluting this volume of replenisher concentrate to prepare a replenisher has a volume of P2f ml, the volume of the fixer replenisher prepared from the fixing package unit, Pf ml, is given as Pf=P1f+P2f (in ml).

Each replenisher concentrate may consist of one part or a plurality of parts. In the latter case, the plural parts are contained in separate reservoirs in amounts corresponding to a mixing ratio, and P1d (or P1f) is a total of the plural parts. Where a plurality of parts are received in a corresponding plurality of reservoirs, the reservoirs are combined together into an assembly to constitute a package unit.

According to the present invention, the volume of the developer replenisher prepared, Pd ml, and the volume of the fixer replenisher prepared, Pf ml, are correlated to the amount of the developer replenisher supplied, (Rep)d ml and the amount of the fixer replenisher supplied, (Rep)f ml, both per square meter of photosensitive material. They satisfy the relationship:

$$(Rep)f/(Ref)d = Pf/Pd \ldots \quad (1)$$

Equation (1) means that (Rep)f/(Ref)d is substantially equal to Pf/Pd with an error in the range of±5%.

Since the replenishers are prepared by diluting the respective replenisher concentrates with water in the predetermined proportion, with equation (1) satisfied, the reservoirs will be emptied of the respective replenisher concentrates at the same timing insofar as the operation is initiated from the same start line such as by installing a new set of developer and fixer replenisher reservoirs at a time.

Each term of equation (1) should have a value of from 0.7 to 1.5, preferably from 0.75 to 1.35. This value is determined by the amounts of the developer and fixer replenishers supplied. The value of (Rep)f/(Ref)d varies within this range because the composition dependency varies between development and fixation in accordance with a particular type of photosensitive material to be processed and a particular processing system associated with a processing solution, and such a variation is compensated for by a replenishment ratio.

In most cases, the developer and the fixer with which the developing and fixing tanks are charged at the start of operation (that is, tank solution) are also prepared by diluting developer and fixer replenisher concentrates with water in the predetermined proportion. Provided that the developer in the developing tank has a volume of Td ml and the fixer in the fixing tank has a volume of Tf ml, the following equation should preferably be satisfied.

$$Td/Tf = Pd/Pf \ldots \quad (2)$$

Equation (2) means that Td/Tf is substantially equal to Pd/Pf with an error in the range of ±5%.

If equation (2) is satisfied, equation (1) is also met by the volumes of replenisher concentrates remaining in respective package units at the point when the tank solutions with which the developing and fixing tanks are charged have been prepared by diluting the replenisher concentrates in the package units. Therefore, even when replenishment is started in the above-mentioned manner using the residual replenisher concentrates, the residual replenisher concentrates in the reservoirs are consumed at the same rate and the reservoirs become empty at the same timing.

By controlling the replenisher supply amounts, tank solution volumes, and package unit capacities so as to satisfy both equations (1) and (2), as solution preparing operation proceeds from the initial preparation of the tank solutions to subsequent preparation of developer and fixer replenishers, the replenisher concentrates in respective reservoirs are consumed at the same rate and eventually the reservoirs become empty at the same time.

In the practice of the present invention, it is only required to satisfy equation (1), preferably both equations (1) and (2), although the package units are preferably adjusted in capacity such that the replenisher concentrates in the respective package units are entirely consumed at the time when tank solutions are prepared therefrom. Then, the operation is still simple even when the proportion of diluting water is different between a tank solution and a replenisher, because replenishers are prepared using new replenisher reservoirs.

As previously described, the present invention is often applied to a situation where the tank solution and the replenisher have the same composition, but may be applied to a situation where the mixing proportion is different therebetween as mentioned just above or a situation where some components are different therebetween. In the latter situations, tank and replenisher solutions are prepared separately using a package unit for the tank solution and another package unit for the replenisher, respectively. The operation becomes simple if the (tank solution) package unit has a controlled capacity such that the replenisher concentrate in the respective package unit is entirely consumed at the time when tank solution is prepared therefrom.

In one preferred embodiment, the tank solution and replenisher are prepared in a stock tank which is in fluid receipt communication with the reservoir and in fluid supply communication with the processing tank. In another preferred embodiment intended for reducing the volume of a stock tank, the stock tank is destined only for mixing and agitation of the replenisher concentrate and dilution with water is conducted in the processing tank (see Japanese Patent Application Nos. 273304/1989 and 268814/1989). Diluting water is supplied from a water supply tank or directly from a city water line. The stock tank used in the other preferred embodiment may have a volume just enough to receive the entire replenisher concentrate of a package unit from which a charge of tank solution can be prepared. An automatic supply system is preferred wherein the stock tank is equipped with another replenisher reservoir such that the replenisher concentrate is automatically fed from the reservoir to the stock tank in accordance with a lowering of the replenisher concentrate in the stock tank in a chicken feeder manner as disclosed in Japanese Patent Application No. 173800/1989.

The present invention is preferably applied to a continuous or running mode of operation wherein the accumulative amount of developer replenished reaches 10 to 100 times the tank volume. Also better results are obtained in operation wherein it takes one day or more until the accumulative amount of developer replenished reaches the tank volume.

The package unit is in the form of a reservoir or container for receiving therein a replenisher concentrate. The material of which the reservoir is made is not particularly limited insofar as it does not adversely affect the components of processing solution. Exemplary are resinous materials such as polyethylene and polyethylene-laminated paper.

In running equilibrium state, the developer contains about 0.05 to about 10 parts by weight of iron calculated as Fe per million parts by weight of the developer in a dissolved state. The dissolved iron derives from water, chemical processing agents or photosensitive material. Undesirably, the presence of iron or a heavy metal having a variable valence renders the developer unstable even in minor amounts.

For the purposes of collecting the dissolved iron, the present invention adds a chelating agent to the developer and its replenisher. In general, chelating agents are used to chelate potassium salts. Since some chelating agents can react with a minor amount of heavy metal to promote oxidation of hydroquinone or other components, a choice of chelating agent needs careful consideration. Among others, ethylenediaminetetraacetic acid (EDTA) tends to promote such oxidation.

By adding a selected chelating agent, the amount of the developer replenished can be reduced as previously described. The chelating agent used herein is preferably selected from those having a chelate stability constant of at least 8 relative to a ferric ion ($Fe^{3+}$). The term "stability constant" is well known in the literature, for example, L. G. Sillen and A. E. Martell, "Stability Constants of Metal Complexes", The Chemical Society, London (1964) and S. Chaberek and A. E. Martell, "Organic Sequestering Agents", Willey (1959).

The chelating agents having a stability constant of at least 8 relative to a ferric ion include organic carboxylic acid chelating agents, organic phosphoric acid chelating agents, inorganic phosphoric acid chelating agents, and polyhydroxy compounds. Illustrative, non-limiting examples include ethylenediaminedi-ortho-hydroxyphenylacetic acid, diaminopropanetetraacetic acid, nitrilotriacetic acid, hydroxyethylethylenediaminetriacetic acid, hydroxyethylglycine, ethylenediaminediacetic acid, ethylenediaminedipropionic acid, iminodiacetic acid, diethylenetriaminepentaacetic acid (DTPA), hydroxyethyliminodiacetic acid, 1,3-diaminopropanoltetraacetic acid, triethylenetetraamine-hexaacetic acid, trans-cyclohexanediaminetetraacetic acid, glycoletherdiaminetetraacetic acid, ethylenediaminetetrakismethylenephosphonic acid, diethylenetriaminepentamethylene-phosphonic acid, nitrilotrimethylenephosphonic acid, 1-hydroxyethylidene-1,1-diphosphonic acid, 1,1.diphosphonoethane-2-carboxylic acid, 2-phosphonobutane,1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate, and sodium hexametaphosphate. Preferred examples include DTPA, triethylenetetraaminehexaacetic acid, 1,3-diaminopropanoltetraacetic acid, glycoletherdiaminetetraacetic acid, hydroxyethylethylenediaminetriacetic acid, 2-phosphono-butane-1,2,4-tricarboxylic acid, 1,1-diphosphonoethane-2-carboxylic acid, nitrilotrimethylenephosphonic acid, ethylenediaminetetraphosphonic acid, diethylenetriamine-pentaphosphonic acid, 1-hydroxypropylidene-1,1-diphosphonic acid, 1-aminoethylidene-1,1-diphosphonic acid, 1-hydroxyethylidene-1,1-diphosphonic acid and salts thereof. Most preferred are polyaminocarboxylic acids and polyaminophosphonic acids among the foregoing examples.

In the practice of the invention, the chelating agent is added to the developer or its replenisher in an amount of 0.01 to 50 grams, especially 0.05 to 20 grams per liter of the developer or its replenisher with better results.

For the purposes of reducing the replenishment of the developer and fixer, it is preferred to reduce the specific surface area of the processing tank, which is the surface area of the solution in interfacial contact with air ($cm^2$) divided by tank solution volume (liter), thereby preventing oxidative deterioration and evaporation of the processing solution. The specific surface area of the processing tank is preferably limited to 50 $cm^2/1$ or lower, more preferably to 40 $cm^2/1$ or lower, most preferably 38 $cm^2/1$ or lower.

The processing method of the present invention is generally applicable to black-and-white photosensitive materials which are subject to development and then fixation. Included are general black-and-white photosensitive materials, for example, ordinary picture taking negative films and black-and-white print papers, laser printer photographic materials and printing photosensitive materials for recording medical images, medical direct radiographic photosensitive materials, medical photofluorographic photosensitive materials, photosensitive materials for recording CRT display images, and industrial X-ray photosensitive materials.

Developer & fixer compositions

Now, the black-and-white development is described. The method uses a black-and-white developer for the development of photosensitive materials which generally contains a developing agent, preservative, alkaline agent, hardener, antifoggant and other additives. It is to be noted that the developer used herein further contains a chelating agent as previously described although the chelating agent is not referred to in the following description.

The developing agent used in the black-and-white developer is mainly a dihydroxybenzene or hydroquinone developing agent while combinations of a hydroquinone with a 1-pheny-3-pyrazolidone or p-aminophenol are preferred for better performance.

Examples of the hydroquinone developing agent include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with the hydroquinone being preferred.

Examples of the p-aminophenol developing agent include N-methyl-p-aminophenol, p-aminophenol, N-(β-hydroxyethyl)-p-aminophenol, N-(4-hydroxyphenyl)glycine, 2-methyl-p-amino-phenol, and p-benzylaminophenol, with the N-methyl-p-amino-phenol being preferred.

Examples of the 3-pyrazolidone developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The hydroquinone developing agent is generally used in an amount of 0.01 to 1.5 mol/liter, preferably 0.05 to 1.2 mol/liter. In addition to the hydroquinone developing agent, the p-aminophenyl or 3-pyrazolidone developing agent is generally used in an amount of 0.0005 to 0.2 mol/liter, preferably 0.001 to 0.1 mol/liter.

The sulfite preservatives in the black-and-white developer according to the present invention include sodium sulfite, potassium sulfite, lithium sulfite, ammonium sulfite, sodium bisulfite, and potassium metabisulfite. The sulfite is generally used in an amount of at least 0.2 mol/liter, preferably from 0.4 to 2.5 mol/liter.

The black-and-white developer is preferably at pH 8.5 to 13, more preferably pH 9 to 12. As previously described, pH 11 is the boundary which dictates a choice of the chelating agent.

For adjusting the pH of the developer, an alkaline agent is used. Included are pH adjusting agents such as sodium hydroxide, potassium hydroxide, sodium carbonate, potassium carbonate, sodium tertiary phosphate, and potassium tertiary phosphate. Also useful are buffer agents, for example, borates as disclosed in Japanese Patent Application Kokai (JP-A) No. 186259/1987, saccharose, acetoxime and 5-sulfosalicylate as disclosed in JP-A 93433/1985, phosphates, and carbonates.

Also used in the developer is a dialdehyde hardener or a bisulfite salt adduct thereof, for example, glutaraldehyde or a bisulfate salt adduct thereof.

Other additives used in the developer include a development retarder such as sodium bromide, potassium bromide, and potassium iodide; an organic solvent such as ethylene glycol, diethylene glycol, triethylene glycol, dimethylformamide, methyl cellosolve, hexylene glycol, ethanol, and methanol; and an antifoggant, for example, mercapto compounds such as 1-phenyl-5-mercaptotetrazole and sodium 2-mercaptobenzimidazole-5-sulfonate, indazole compounds such as 5-nitroindazole, and benzotriazole compounds such as 5-methylbenzotriazole. Also added to the black-and-white developer according to the present invention are a development promoter as disclosed in Research Disclosure, Vol. 176, No. 17643, Item XXI (December 1978), and if desired, a color toning agent, a surface-active agent, a debubbling agent, a water softener, and an amino compound such as alkanol amine as disclosed in JP-A 106244/1981 and EP 0136582.

Anti-sludging agents may be added to the black-and-white developer according to the present invention. Such anti-silver-sludging agents, typically thioctic acid, are described in JP-A 24347/1981 and Japanese Patent Publication (JP-B) No. 46585/1981.

In the practice of the present invention, the developer is prepared by diluting a developer concentrate with water, the developer concentrate consisting of one part or a plurality of parts. A two or three part system is typical. In the two part system, the components are divided into an alkaline part containing a developing agent and a part containing a hardener. In the three part system, the components are divided into a first part containing a developing agent (e.g., hydroquinone), a second part containing an auxiliary developing agent, and a third part containing a hardener.

The above-described development is followed by fixation. Fixation uses a fixer which is an aqueous solution containing a thiosulfate at pH 3.8 or higher, preferably pH 4.2 to 7.0.

The fixing agents include sodium thiosulfate and ammonium thiosulfate although the ammonium thiosulfate is preferred for fixing rate. The fixing agent is added in a varying amount, generally from about 0.1 to 3 mol/-liter.

Also added to the fixer is a hardener including water soluble aluminum salts, for example, aluminum chloride, aluminum sulfate, and potassium alum. The fixer may contain tartaric acid, citric acid, gluconic acid or derivatives thereof alone or in admixture of two or more in an amount of at least 0.005 mol/liter, preferably 0.01 to 0.03 mol/liter. If desired, the fixer may further contain preservatives (e.g., sulfites and bisulfites), pH buffer agents (e.g., acetic acid and boric acid), pH adjusting agents (e.g., sulfuric acid), chelating agents capable of softening hard water, and the compounds disclosed in JP-A 78551/1987.

To reduce the amount of the fixer replenished, such compounds as disclosed in U.S. Pat. No. 4,906,553 or Japanese Patent Application No. 239278/1989 may be added to the fixer for the purposes of promoting fixation and assisting in dissolving out sensitizing dyes.

In the practice of the present invention, the fixer is prepared by diluting a fixer concentrate with water, the fixer concentrate consisting of one part or a plurality of parts. Typical is a two part system which consists of a first part containing an acidic hardener (e.g., water soluble aluminum salts) and a second part containing the remaining components.

After development and fixation, the photosensitive material may be processed with wash water or stabilizer which is replenished at a flow rate of up to 3 liters per square meter of the photosensitive material (inclusive of 0, that is, pool water washing).

One way of reducing the replenisher amount is a multi-stage (e.g., 2 or 3 stage) counterflow mode as is well known from the old days. With the multi-stage counterflow mode, the photosensitive material after fixation is washed successively in a gradually cleaner direction, that is, with cleaner solutions contaminated with a less amount of the fixer, resulting in more efficient washing.

In the case of water-saving washing or non-piping washing, wash water or stabilizer should preferably be provided with antifungal means. The antifungal means include UV radiation as disclosed in JP-A 26393/1985, a magnetic field as disclosed in 263940/1985, the use of an ion exchange resin to produce pure water as disclosed JP-A 131632/1986, ozone blowing, and the use of antibacterial agents as disclosed in JP-A 51396/1986, 63030/1986, 115154/1987, 153952/1987, and 91533/1989. Also useful is combined use of biocidal agents, antifungal agents and surface active agents as disclosed in L. F. West, "Water Quality Criteria", Photo. Sci. & Eng., Vol. 9, No. 6(1965), M. W. Beach, "Microbiological Growths in Motion-Picture Processing", SMPTE Journal, Vol. 85 (1976), R. O. Deegan, "Photo Processing Wash Water Biocides", J. Imaging Tech., 10, No. 6(1984), and JP-A 8542/1982, 58143/1982, 97530/1982, 132146/1982, 157244/1982, 18631/1983, and 105145/1983.

The wash water or stabilizer bath may additionally contain microbiocides, for example, the isothiazoline compounds as described in R. T. Kreiman, J. Image Tech., 10, 6 (1984), page 242, Research Disclosure, Vol. 205, No. 20526 (May 1981), and ibid., Vol. 228, No. 22845 (April 1983); and the compounds described in Japanese Patent Application No. 51396/1986.

Also useful is a silver cation sustained release source which may be an amorphous soluble glass containing monovalent silver as disclosed in JP-A 39692/1988. The amorphous soluble glass is generally formed from at least one network forming oxide selected from $SiO_2$, $B_2O_3$, and $P_2O_5$, at least one network modifying oxide selected from $Na_2O$, $K_2O$, CaO, MgO, BaO, and ZnO, and at least one intermediate oxide selected from $Al_2O_3$ and $TiO_2$ and contains $Ag_2O$ in an amount of 0.05 to 10% by weight, preferably 0.1 to 5% by weight. The amorphous soluble glass becomes gel in water, retains a given amount of silver cations in the gel, and gradually release silver cations into water. The glass may be in a mass, granular or powder form. It is received in a water-permeable container which is placed in water. The amorphous soluble glass is used in an amount of 500 to 20,000 grams per cubic meter of wash water tank volume.

Also useful are compounds as described in H. Horiguchi, "Bokin Bobai No Kagaku (Chemistry of Antifungal and Biocidal Agents)", Sankyo Publishing K. K. (1982) and "Bokin Bobai Gijutu Handbook (Antifungal and Biocidal Technical Handbook)", Japan Antifungal and Biocidal Associate, Hakuhodo K. K. (1986).

When washing with a small amount of water, a squeeze roller wash tank is preferably used as disclosed in JP-A 18350/1988. A washing procedure as disclosed in JP-A 143548/1988 is also preferred.

As water having antifungal means applied thereto is replenished to a washing or stabilizing tank in proportion to the processing quantity, an overflow exits the tank. It is possible to utilize part or all of the overflow as a processing solution having a fixing function in the preceding step.

Several terms are defined in conjunction with a sequence of successively processing a length of photo sensitive material through a developing tank, a fixing tank, a washing tank, and then a drying section of an automatic processor. "Developing time" is a duration taken from the point when the leading edge of a length of photosensitive material is dipped in a developer in the developing tank to the point when it is dipped in a fixer in the fixing tank. "Fixing time" is a duration taken from the point when the leading edge is dipped in the fixer to the point when it is dipped in wash water or stabilizer in the washing tank. "Washing time" is a duration when the photosensitive material is dipped in the wash tank liquid. "Drying time" is a duration when the photosensitive material passes through the processor drying section which is usually designed to blow hot air at a temperature of 35° to 100° C., preferably 40° to 80° C.

In development, the developing time generally ranges from 5 seconds to 3 minutes, preferably from 8 seconds to 2 minutes while the temperature ranges from 18° to 50° C., preferably from 20° to 40° C.

In fixation, the fixing time generally ranges from 5 seconds to 3 minutes at a temperature of about 18° to 50° C., preferably from 6 seconds to 2 minutes at a temperature of about 20° to 40° C.

In water washing, the washing time generally ranges from 6 seconds to 3 minutes at a temperature of about 0° to 50° C., preferably from 6 seconds to 2 minutes at a temperature of about 10° to 40° C.

Having finished development, fixation and washing (or stabilization), the photosensitive material is removed of the wash water, that is, squeezed of water through squeeze rollers and then dried. Drying is generally at about 40° to 100° C. The drying time may vary with the ambient condition, usually in the range of from 5 seconds to 3 minutes, preferably from 5 seconds to 2 minutes at 40° to 80° C.

In carrying out development process within 100 seconds on a dry-to-dry basis in a photosensitive material processing system as mentioned above, it is recommended to provide the developing tank at the outlet with rollers of rubbery material for reducing a development variation inherent to quick processing as disclosed in JP-A 151943/1988, to circulate the developer at a flow rate of 10 m/min. or higher in the developing tank for agitating the developer as disclosed in JP-A 151944/1988, and to effect more intense agitation during processing periods than during standby periods as disclosed in JP-A 264758/1988. For quick processing, rollers are preferably arranged in the fixing tank in an opposed fashion in order to increase the fixing rate. The opposed roller arrangement reduces the number of rollers used and the volume of the fixing tank. The processor becomes more compact.

The processor may be provided with means for washing the cross-over rollers between the developing and fixing tanks and between the fixing and washing tanks by spraying water thereto (JP-A 187243/1988 and 131338/1986).

Photosensitive material

The photosensitive materials to which the present invention is applicable bear thereon a photographic emulsion containing silver halide grains. The silver halide grains may be regular grains having regular crystallographic form such as cubic, octahedral and tetradecanohedral (14-sided), grains of irregular crystallographic form such as spherical, grains having crystal defects such as twin plane, plate-shaped grains or a mixture thereof.

When plate-shaped grains are used in the emulsion of the photosensitive material to be processed according to the invention, the plate-shaped grains preferably have an aspect ratio of from 4 to less than 20, more preferably from 5 to less than 10 while the thickness is preferably up to 0.3 μm, especially up to 0.2 μm, provided that the aspect ratio is defined as a ratio of an average diameter of a circle having an equal area to the projected area of individual grains to an average thickness of individual grains. Preferably the plate-shaped grains are present in an amount of at least 80% by weight, more preferably at least 90% by wight of the total weight of silver halide grains.

The silver halide grains may form a monodispersed emulsion having a narrow distribution of grain size or a polydispersed emulsion having a wide distribution of grain size.

The photographic silver halide emulsion used herein may be prepared by well-known methods, for example, as described in Research Disclosure, No. 17643 (December 1978), pages 22–23, "I. Emulsion preparation and types" and ibid., No. 18716 (November 1979), page 648. Other applicable emulsion preparing methods are described in the literature, for example, Glafkides, Chemie et Physique Photographique, Paul Montel, 1967; G. F. Duffin, Photographic Emulsion Chemistry, Focal Press, 1966; and V. L. Zelikman et al, Making and Coating Photographic Emulsion, Focal Press, 1964.

For controlling the growth of silver halide grains during their formation, there may be used an agent for solubilizing silver halide, for example, ammonia, potassium thiocyanate, ammonium thiocyanate, and thioethers as disclosed in U.S. Pat. Nos. 3,271,157, 3,574,628, 3,704,130, 4,297,439, and 4,276,374; thion compounds as disclosed in JP-A 144319/1978, 82408/1978, and 77737/1980, and amine compounds as disclosed in JP-A 100717/1979. Water soluble rhodium and iridium salts of these compounds are also useful.

The mode of reaction of a soluble silver salt with a soluble halide salt may be single jet mixing, double jet mixing, and a combination thereof. Also employable is a method of forming silver halide grains in the presence of excess silver ions, which is known as a reverse mixing method. One special type of simultaneous mixing method is by maintaining constant the pAg of a liquid phase in which a silver halide is formed, which is known as a controlled double jet method. This method leads to a silver halide emulsion having a regular crystalline shape and a nearly uniform particle size.

The silver halide emulsion may be chemically sensitized, for example, by conventional sulfur sensitization, reducing sensitization, noble metal sensitization and a combination thereof. Useful chemical sensitizers include sulfur sensitizers such as allyl thiocarbamide, thioureas, thiosulfates, thioethers and cystine; noble metal sensitizers such as potassium chloroaurate, aurous thiosulfate and potassium chloropalladate; and reducing sensitizers such as phenylhydrazine and reductone.

The silver halides used herein may be spectrally sensitized with well known spectral sensitizing dyes if desired. The dyes useful for spectral sensitization include cyanine dyes, merocyanine dyes, rhodacyanine dyes, styryl dyes, hemicyanine dyes, oxonol dyes, benzylidene dyes, and holopolar dyes as described in F. M. Hamer, "Heterocyclic Compounds-The Cyanine Dyes and Related Compounds", John Wiley & Sons (1964) and D. M. Sturner, "Heterocyclic Compounds-Special Topics in Heterocyclic Chemistry", John Wiley & Sons (1977), with the cyanine and merocyanine dyes being preferred.

Preferred examples of the sensitizing dye include cyanine and merocyanine dyes of the general formulae defined in JP-A 122928/1975, 212827/1984, 1801553/1984, 133442/1985, 75339/1986, and 6251/1987, more specifically, sensitizing dyes capable of spectral sensitization of silver halides in blue, green, red or infrared spectra set forth in pages 7–9 of JP-A 122928/1975, pages 5–7 of JP-A 212827/1984, pages 7–18 of JP-A 1801553/1984, pages 8-11 of JP-A 133442/1985, pages 5–7 and 24–25 of JP-A 75339/1986, and pages 10–15 of JP-A 6251/1987.

The sensitizing dyes may be used alone or in combination. Combinations of sensitizing dyes are often used particularly for the purpose of supersensitization.

Along with the sensitizing dyes, the emulsions may contain dyes which themselves have no spectral sensitization effect or substances which do not substantially absorb visible light, but have the nature of supersensitization. Useful are aminostyryl compounds having a nitrogenous heterocyclic substituent as described in U.S. Pat. Nos. 2,933,390 and 3,635,721, aromatic organic acid-formaldehyde condensates as described in U.S. Pat. No. 3,743,510, cadmium salts and azaindenes. Especially useful combinations are described in U.S. Pat. No. 3,615,613, 3,615,641, 3,617,295, and 3,635,721.

The sensitizing dye is preferably used in an amount of $5\times10^{=7}$ to $5\times10^{-2}$ mol, more preferably $1\times10^{-6}$ to $1\times10^{-3}$ mol, most preferably $2\times10^{-6}$ to $5\times10^{-4}$ mol per mol of silver halide in the photographic silver halide emulsion.

The sensitizing dye can be directly dispersed in the emulsion layer. Alternatively, the sensitizing dye is first dissolved in a suitable solvent such as methyl alcohol, ethyl alcohol, methyl cellosolve, acetone, water, pyridine or a mixture thereof to form a solution which is added to the emulsion. Ultrasonic vibration may assist in dissolving the dye. Further, the sensitizing dye may be added to the emulsion through various procedures, for example, by dissolving the dye in a volatile organic solvent, dispersing the solution in hydrophilic colloid, and adding the dispersion to the emulsion as described in U.S. Pat. No. 3,469,987; by dispersing a water-insoluble dye in a water-soluble solvent and adding the dispersion to the emulsion as described in JP-B 24185/1971; by grinding and dispersing a water-insoluble dye in an aqueous medium and adding the dispersion to the emulsion as disclosed in JP-B 45217/1986; by dissolving a dye in a surface-active agent and adding the solution to the emulsion as disclosed in U.S. Pat. No. 3,822,135; by dissolving a dye in a red-shifting compound and adding the solution to the emulsion as disclosed in JP-A 74624/1976; and by dissolving a dye in a substantially water-free acid and adding the solution to the emulsion as disclosed in JP-A 80826/1975. Alternatively, the dye may be added to the emulsion by such methods as described in U.S. Pat. Nos. 2,912,343, 3,342,605, 2,996,287, and 3,429,835. The sensitizing dye may be uniformly dispersed in the silver halide emulsion at any stage of its preparation or after its preparation, but prior to application to a suitable support, for example, during or prior to chemical sensitization, or prior to, during or subsequent to silver halide grain formation according to the teachings of U.S. Pat. Nos. 4,183,756 and 4,225,666. It is known that when a sensitizing dye is added during or prior to chemical sensitization, or prior to, during or subsequent to silver halide grain formation, the dye is strongly adsorbed to the silver halide. A photosensitive material using a silver halide emulsion prepared in this way is also an objective to which the present invention is applicable.

Another sensitizing dye can be used in combination with any of the above-mentioned sensitizing dyes. Useful sensitizing dyes are disclosed in the following patents.

U.S. Pat. Nos.
2,615,613 2,688,545 3,397,060
3,416,927 3,615,632 3,615,635
3,617,295 3,628,964 3,635,721
3,703,377

UK Patent Nos.
1,242,588 1,293,862

JP-B
4930/1968 4936/1968 10773/1968
14030/1969

The hardeners which can be used in the emulsions include various organic compounds, for example, aldehydes, compounds having active halogen as described in U.S. Pat. No. 3,288,775, compounds having a reactive ethylenically unsaturated group as described in U.S. Pat. No. 3,635,718, epoxy compounds as described in U.S. Pat. No. 3,091,537, and halogenocarboxyaldehydes such as mucochloric acid. Among others, vinylsulfone hardeners are preferred as well as high polymer hardeners. Preferred high polymer hardeners are polymers having an active vinyl group or a precursor thereof, especially polymers having an active vinyl group or a precursor thereof attached to their backbone through a long spacer as described in JP-A 142524/1981. The amount of the hardener added may be determined so as to provide an adequate swelling factor, depending on the type of gelatin or the like.

In rapid processing, the emulsion layer and/or another hydrophilic colloid layer preferably contains an organic substance which can be dissolved out during development. If this substance is gelatin, gelatin of the type which does not participate in crosslinking reaction of gelatin by the hardener is preferred. Such special type of gelatin includes acetylated gelatins and phthalated gelatins, with ones having a lower molecular weight being preferred. Polymers other than gelatin include polyacrylamide as disclosed in U.S. Pat. No. 3,271,158, hydrophilic polymers such as polyvinyl alcohol and polyvinyl pyrrolidone, and saccharides such as dextran, saccharose and pluran. Preferred are polyacrylamide and dextran, with the polyacrylamide being most preferred. These polymers have an average molecular weight of up to 20,000, more preferably up to 10,000. In addition, antifoggants and stabilizers as disclosed in Research Disclosure, Vol. 176, No. 17643, Item VI (December 1978) may be used.

The present invention is also applicable to the image formation process of photographic silver halide photosensitive materials using hydrazine derivatives capable of providing photographic properties of super high contrast and high sensitivity as disclosed in U.S. Pat. No. 4,166,742, 4,168,977, 4,221,957, 4,224,401, 4,243,739, 4,272,606, and 4,311,781. The hydrazine derivatives are described in Research Disclosure, Item 23516, page 346 (November 1983) and the references cited therein, as well as U.S. Pat. Nos. 4,080,207, 4,269,929, 4,276,364, 4,278,748, 4,385,108, 4,459,347, 4,478,928, and 4,560,638, UK Patent No. 2,011,391B, and JP-A 179734/1985. The hydrazine derivative is preferably added in an amount of $1\times10^{-6}$ to $5\times10^{-2}$ mol, more preferably $1\times10^{-5}$ to $2\times10^{-2}$ mol per mol of silver halide.

In the processing of this special photosensitive material, the developer should preferably contain an amino compound as a contrast enhancer as disclosed in U.S. Pat. No. No. 4,269,929.

The photosensitive materials to which the present invention is applicable may have a silver coating weight of up to 3.5 grams, preferably 1 to 3.2 grams per square meter on one side.

EXAMPLE

Examples of the present invention are given below by way of illustration and not by way of limitation. In the examples, Mw is an average molecular weight, and whenever reference is made to a sheet of photosensitive material, it a sheet of $10\times12$ inch size also known as the quarter size.

EXAMPLE 1

Preparation of emulsion

To 1 liter of water were added 5 grams of potassium bromide 25.6 grams of gelatin, and 2.5 ml of an aqueous solution of 5% thioether $HO(CH_2)_2S(CH_2)_2S(CH_2)_2OH$. To this solution at 66° C., with stirring, an aqueous solution containing 8.33 grams of silver nitrate and another aqueous solution containing 5.94 grams of potassium bromide and 0.726 grams of potassium iodide were added over 45 seconds by a double jet mixing method. Then, 2.9 grams of potassium bromide was added, an aqueous solution containing 8.33 grams of silver nitrate added over 24 minutes, and thereafter, 0.1 mg of thiourea dioxide of the formula added:

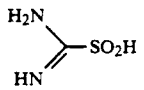

To the resulting solution were added 20 ml of 25% aqueous ammonia and 10 ml of 50% ammonium nitrate aqueous solution. After 20 minutes of physical ripening, 240 ml of 1N sulfuric acid was added to the solution for neutralization. Subsequently, an aqueous solution containing 153.34 grams of silver nitrate and an aqueous solution containing potassium bromide and potassium iodide were added to the solution over 40 minutes by a controlled double jet method while maintaining the solution potential at pAg 8.2. The flow rate of each solution was increased such that the final flow rate was 9 times the initial flow rate. At the completion of addition, 15 ml of a 2N potassium thiocyanate solution was added and then, 45 ml of an aqueous 1% potassium iodide solution added over 30 seconds.

Then, the solution was cooled to a temperature of 35° C. for allowing the soluble salts to be removed by sedimentation. The temperature was raised to 40° C. and 76 grams of gelatin, 76 mg of proxcel, and 760 mg of phenoxyethanol were added to the emulsion, which was adjusted to pH 6.50 and pAg 8.20 with sodium hydroxide and potassium bromide.

After the temperature was raised to 56° C., there were added 186 mg of 4-hydroxy-6-methyl-1,3,3a,7-tetraazaindene and after 10 minutes, 520 mg of a sensitizing dye having the following structure.

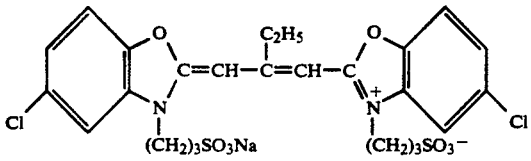

There was obtained an emulsion in which those grains having an aspect ratio of at least 3 occupied 99.5% of the projected area of the entire grains, and all the grains having an aspect ratio of at least 2 had an average projection area diameter of 1.48 μm with a standard deviation of 25.6%, an average thickness of 0.195 μm, and an average aspect ratio of 7.6. The total iodine content was 1.2 mol% based on the total silver quantity.

Preparation of emulsion coating composition

A coating composition was prepared by adding the following chemicals to the emulsion in the amounts reported per mol of silver halide.

| | |
|---|---|
| Polymer latex<br>poly(ethylacrylate/methacrylic acid) = 97/3 | 25.0 g |
| Hardener<br>1,2-bis(vinylsulfonylacetamide)ethane | 3.0 g |
| 2,6-bis(hydroxyamino)-4-diethylamino-1,3,5-triazine | 80 mg |
| Sodium polyacrylate (Mw = 41,000) | 4.0 g |
| Potassium polystyrenesulfonate (Mw = 600,000) | 1.0 g |
| Polyacrylamide (Mw = 45,000) | 24.0 g |

Preparation of support

A blue-colored polyethylene terephthalate (PET) support of 175 μm thick was coated on each surface with a primer layer of the following components.

| Components | Coating weight |
|---|---|
| Gelatin | 84 mg/m² |
| Polymer: | 60 mg/m² |

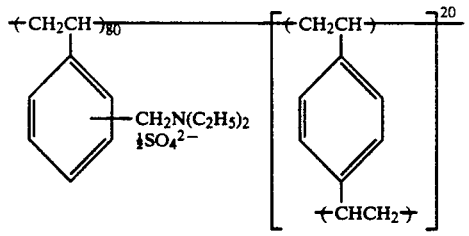

| | |
|---|---|
| Dye: | 17 mg/m² |

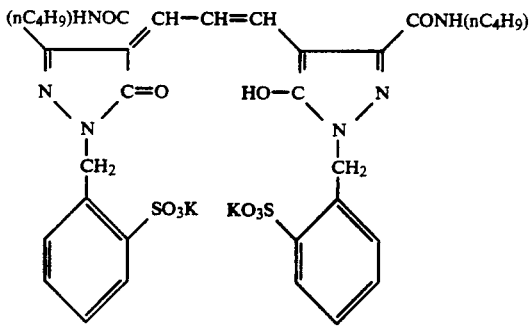

Preparation of photosensitive material A

The emulsion coating composition was coated to either surface of the support along with a surface protective layer coating composition. The amount of silver coated was 1.85 g/m² on each side.

The surface protective layer coating composition used had been prepared to form a surface protective layer consisting of the following components. (n: degree of polymerization)

| Surface protective layer | Coating weight |
|---|---|
| Gelatin | 1.15 g/m² |
| Polyacrylamide (Mw = 45,000) | 0.25 g/m² |
| Sodium polyacrylate (Mw = 400,000) | 0.02 g/m² |
| Sodium p-t-octylphenoxydiglyceryl-butylsulfonate | 0.02 g/m² |

-continued

| Surface protective layer | Coating weight |
|---|---|
| Polyoxyethylene(n=10) cetyl ether | 0.035 g/m$^2$ |
| Polyoxyethylene(n=10)/polyoxyglyceryl (n=3) p-octylphenoxy ether | 0.01 g/m$^2$ |
| 4-hydroxy-6-methyl-1,3,3a,7-tetraazaindene | 0.0155 g/m$^2$ |
| 2-chlorohydroquinone | 0.154 g/m$^2$ |
| $C_8F_{17}SO_3K$ | 0.003 g/m$^2$ |
| $C_8F_{17}SO_2N(C_3H_7)-(CH_2CH_2O)_4-(CH_2)_4-SO_3Na$ | 0.001 g/m$^2$ |
| $C_8F_{17}SO_2N(C_3H_7)-(CH_2CH_2O)_{15}-H$ | 0.003 g/m$^2$ |
| Polymethyl methacrylate (mean particle size 3.5 μm) | 0.025 g/m$^2$ |
| Poly(methyl methacrylate/methacrylate) (molar ratio 7:3, mean particle size 2.5 μm) | 0.020 g/m$^2$ |

In this way, there was obtained a photosensitive material having a coating with a swelling factor of 230% (as defined in JP-A 111933/1983).

Development process

Preparation of concentrates

Developer and fixer concentrates having the following composition were prepared.

| | |
|---|---|
| Developer | |
| Part A | |
| Potassium hydroxide | 330 g |
| Potassium sulfite | 630 g |
| Sodium sulfite | 255 g |
| Potassium carbonate | 45 g |
| Boric acid | 45 g |
| Diethylene glycol | 180 g |
| DTPA (chelating agent) | 30 g |
| 5-methylbenzotriazole | 0.225 g |
| Hydroquinone | 450 g |
| Water | totaling to 4125 ml |
| Part B | |
| Diethylene glycol | 525 g |
| 3,3'-dithiobishydrocinnamic acid | 3 g |
| Glacial acetic acid | 102.6 g |
| 5-nitroindazole | 3.75 g |
| 1-phenyl-3-pyrazolidone | 34.5 g |
| Water | totaling to 750 ml |
| Part C | |
| Glutaraldehyde (50 wt/wt %) | 150 g |
| Sodium metabisulfite | 105 g |
| Potassium bromide | 15 g |
| Water | totaling to 750 ml |
| Fixer | |
| Ammonium thiosulfate (70 wt/vol %) | 3000 ml |
| Disodium EDTA dihydrate | 0.45 g |
| Sodium sulfite | 225 g |
| Boric acid | 60 g |
| 1-(N,N-dimethylamino)ethyl-5-mercaptotetrazole | 15 g |
| Tartaric acid | 48 g |
| Glacial acetic acid | 675 g |
| Sodium hydroxide | 225 g |
| Sulfuric acid (36 N) | 58.5 g |
| Aluminum sulfate | 150 g |
| Water | totaling to 6000 ml pH 4.68 |

Preparation of processing solutions

Developer concentrate parts A, B and C were admitted into three separate compartments which had been integrated together as a polyethylene reservoir having a puncturable cap at the top. This is designated a developer replenisher kit. The fixer concentrate was admitted into another polyethylene reservoir having a puncturable cap at the top. This is designated a fixer replenisher kit.

The reservoirs were turned up side down and installed in an automatic processor in side by side relation to stock tanks whereby a knife edge at the inlet of each stock tank punctured the cap of the corresponding reservoir, allowing the charge in the reservoir to flow into the stock tank.

Each stock tank had a volume enough to receive the entire charge of a corresponding replenisher kit. The stock tank was provided with means for installing a second replenisher kit and allowing the charge in the second kit to be supplied to the stock tank in proportion to a lowering of the solution in the stock tank in a chicken feeder manner (see Japanese Patent Application No. 173800/1989).

First, the developer and fixer (tank) solutions were fed from the stock tanks to the developing and fixing tanks in the following proportion by means of metering pumps also built in the processor, respectively. The developing and fixing tanks each had a capacity capable of receiving 15 liters of solution. That is, Td=Tf=15,000 ml.

The developer and fixer replenishers were diluted with water in the following proportion.

| | | |
|---|---|---|
| Developer | | |
| Part A | 55 ml | Total 200 ml |
| Part B | 10 ml | |
| Part C | 10 ml | |
| Water | 125 ml | |
| pH 10.50 | | |
| Fixer | | |
| Concentrate | 80 ml | Total 200 ml |
| Water | 120 ml | |
| pH 4.62 | | |

It is to be noted that the developer as the tank solution contained the chelating agent in a concentration of 2 g/l.

Every time when 8 sheets of photosensitive material were processed, the replenisher concentrates were diluted with water in the same proportion as above and supplied to the corresponding processor tanks.

The developer and fixer replenisher kits each had a capacity of providing 15 liters of processing solution (after dilution). That is, Pd=Pf=15,000 ml.

For the developer, the developer kit consisted of a reservoir defining three compartments containing 4125 ml of part A, 750 ml of part B, and 750 ml of part C in accordance with their mixing proportion so that the parts would be combined and diluted with water to provide 15 liters of developer. This kit is a developer package unit. The developer replenisher contained the chelating agent in the same concentration as in the tank solution. Since the fixer used a one part concentrate, the fixer kit consisted of a reservoir containing 6000 ml of fixer concentrate so that it would be diluted with water to provide 15 liters of fixer. This kit is a fixer package unit.

The wash tank was filled with city water. In the tank were placed two bags of non-woven fabric each containing 200 grams of a silver cation timed release agent in the form of soluble amorphous glass $Na_2O/B_2O_5$/-

$SiO_2$ (10/65/25 wt%) containing 1.7% by weight of $Ag_2O$. The bags were placed in stainless steel (SUS 316) cages which were submerged in the tank so that the bags were spaced 5 mm above the tank bottom.

The processor used was of the following design.

| Step | Tank volume | Processor design: Processing temperature | Path length | Process time |
|---|---|---|---|---|
| Development | 15 l | 35° C. | 613 mm | 13.3 sec. |
| (solution surface area/tank volume ratio = 35 $cm^2/l$) | | | | |
| Fixation | 15 l | 32° C. | 541 mm | 11.7 sec. |
| (solution surface area/tank volume ratio = 37 $cm^2/l$) | | | | |
| Washing | 13 l | 17° C. flowing water | 305 mm | 5.7 sec. |
| Squeezing | | | | 6.6 sec. |
| Drying | | 58° C. | 368 mm | 8.0 sec. |
| Total | | | 1827 mm | 45.3 sec. |

Processing

Using the processor of the above design having the tanks filled with the predetermined volumes of the respective tank solutions, sheets (10×12 inches) of photo. sensitive material A prepared above, after X-ray exposure, were developed and processed according to the above schedule while the developer and fixer were replenished in an amount of 25 ml and 25 ml per sheet, respectively. That is, (Rep)d=(Rep)f=323 ml/$m^2$.

Wash water was fed at a flow rate of 5 liter/min. (corresponding to a feed rate of about 0.5 liter/sheet) by opening an electromagnetic valve in a water feed line in synchronization with the duration of processing the photo-sensitive material. The processor was further designed such that at the end of daily operation, the wash tank was emptied of water by automatically opening the electromagnetic valve. The crossover rollers between the developing and fixing tanks and between the fixing and washing tanks were washed by automatically spraying 60 ml of wash water thereto (from a water supply tank having the soluble amorphous glass submerged therein) two times while rotating the crossover rollers. (See Japanese Patent Application Nos. 131338/1986, 18636/1987, and 88799/1990.)

The operation was continued for 3 months with the average number of sheets processed set to about 200 sheets per day. The operating conditions included (Rep)f/(Rep)d=Pf/Pd=1 and Pd/Pf=Td/Tf.

In the above operation, the developing and fixing tanks of the processor each contained 15 liters of solution, while the developer and fixer replenisher kits each were designed to provide 15 liters of solution. Then, at the tank solution preparation stage, both the developer and fixer replenisher kits were empty, avoiding the inconvenience that one kit was empty, but some concentrate was left in the other kit.

At the subsequent replenishment stage, replenishment of both the developer and fixer was started using a new set of developer and fixer replenisher kits which were installed to the stock tanks. Since both the developer and fixer replenishers were made up in the same amount per unit area of photosensitive material, the replenisher concentrates were consumed at the same rate. Since the replenisher concentrates were received in the replenisher kits in the predetermined volumes, the kits were emptied at the same timing.

As is evident from above, the replacement of developer and fixer replenisher kits was needed at the same timing throughout the period when the operation was continued for 3 months. Daily maintenance burden on the operator was significantly mitigated.

EXAMPLE 2

Photosensitive material B was prepared by the same procedure as used for photosensitive material A in Example 1 except that the amount of the hardener added to the emulsion coating solution was changed to 4.5 grams. Photosensitive material B had a coating with a swelling factor of 180% as defined in Example 1.

The developer and fixer used in this example had the following compositions.

| Developer | |
|---|---|
| Potassium hydroxide | 195.2 g |
| Sodium sulfite | 320 g |
| Potassium sulfite | 400 g |
| DTPA (chelating agent) | 16 g |
| Potassium carbonate | 40 g |
| Potassium bromide | 16 g |
| Boric acid | 24 g |
| Hydroquinone | 280 g |
| Diethylene glycol | 200 g |
| 4-hydroxymethyl-4-methyl-1-phenyl-3-pyrazolidone | 40 g |
| 5-methylbenzotriazole | 0.48 g |
| Water | totaling to 3200 ml |

| Fixer | I | II |
|---|---|---|
| Ammonium thiosulfate (70 wt/vol %) | 1200 ml | 1200 ml |
| Disodium EDTA dihydrate | 0.18 g | 0.18 g |
| Sodium sulfite | 102 g | 102 g |
| Sodium hydroxide | 69 g | 49.2 g |
| Tartaric acid | 204 g | — |
| Acetic acid | — | 180 g |
| Water totaling to | 3000 ml | 1500 ml |

For the fixer, two different fixer concentrates I and II were prepared as formulated above.

The concentrates were admitted into respective reservoirs of the following paper base laminate. (interior) polyethylene/K-nylon/polyethylene/aluminum/polyethylene/paper board/polyethylene (exterior)

A first run used fixer concentrate I.

The stock tanks of the same construction as in Example 1 were charged with the solution concentrates from their reservoirs.

By pumping the concentrates from the stock tanks and diluting them with water in the predetermined proportions, the developing and fixing tanks of the processor were charged with tank solutions in the same manner as in Example 1. The developing and fixing tanks had a capacity of receiving 8 liters and 6 liters of solution, respectively. That is, Td=8000 ml and Tf=6000 ml.

Every time when 3 sheets of photosensitive material were processed, the replenisher concentrates were diluted with water in the predetermined proportions and supplied to the corresponding processor tanks.

The developer and fixer replenisher kits had a capacity of providing 8 liters and 6 liters of processing solution by diluting with water, respectively. The concentrate was received in the kit in an amount to match with the dilution proportion with water. The developer kit contained 3.2 liters of the developer concentrate and the fixer kit contained 3 liters of the fixer concentrate. Thus, Pd=8000 ml and Pf=6000 ml.

The developer and fixer replenishers were diluted with water in the following proportions.

| | | |
|---|---|---|
| Developer | | |
| Concentrate | 38.4 ml | Total 96 ml |
| Water | 57.6 ml | |
| pH 10.65 | | |
| Fixer I | | |
| Concentrate I | 36 ml | Total 72 ml |
| Water | 36 ml | |
| pH 5.0 | | |

The wash tank was charged with city water. Through a perforated conduit extended on the bottom of the wash tank, 3 liter/min. of air containing 200 ppm of ozone was injected into water for 5 minutes at intervals of 15 minutes.

It is to be noted that the developer including the tank solution and replenisher contained the chelating agent in a concentration of 2 g/l.

The processor used was of the following design.

| | Processor design | | | |
|---|---|---|---|---|
| Step | Tank volume | Processing temperature | Path length | Process time |
| Development | 8 l | 35° C. | 360 mm | 16.5 sec. |
| (solution surface area/tank volume ratio = 30 $cm^2/l$) | | | | |
| Fixation | 6 l | 32° C. | 246 mm | 11.3 sec. |
| (solution surface area/tank volume ratio = 32 $cm^2/l$) | | | | |
| Washing | 6 l | 17° C. | 170 mm | 7.8 sec. |
| Squeezing | | | 194 mm | 8.9 sec. |
| Drying | | 58° C. | 212 mm | 9.7 sec. |
| Total | | | 1182 mm | 54.2 sec. |

Processing

Using the processor of the above design having the tanks filled with the predetermined volumes of the respective tank solutions, sheets (10×12 inches) of photosensitive material B, after X-ray exposure, were developed and processed according to the above schedule while the developer and fixer were replenished in an amount of 32 ml and 24 ml per sheet, respectively.

The remaining conditions including replenishment of wash water and washing of crossover rollers were substantially in accord with Example 1.

The operation was continued for 3 months with the average number of sheets processed set to about 50 sheets per day.

The operating conditions included (Rep)d=413 ml/$m^2$, (Rep)f=310 ml/$m^2$, (Rep)f/(Rep)d=Pf/Pd=$\frac{3}{4}$, and Pd/Pf=Td/Tf.

In the above operation, the developing and fixing tanks of the processor contained 8 liters and 6 liters of solution, respectively, while the developer and fixer replenisher kits were designed to provide 8 liters and 6 liters of solution in accordance with the tank volumes, respectively. Then, at the tank solution preparation stage, both the developer and fixer replenisher kits were empty, avoiding the inconvenience that some concentrate was left in one kit while the other was empty.

At the subsequent replenishment stage, replenishment of both the developer and fixer was started using a new set of developer and fixer replenisher kits which were installed to the stock tanks. Since the developer and fixer replenishers were made up in amounts per unit area of photosensitive material at a proportion of 4/3, the replenisher concentrates were consumed at the same rate. Since the replenisher concentrates received in the replenisher kits had proportional volumes as previously described, the kits were emptied at the same timing.

Thus, the replacement of developer and fixer replenisher kits was needed at the same timing throughout the period when the operation was continued for 3 months. Daily maintenance burden on the operator was significantly mitigated.

A second run used fixer concentrate II in the same manner as above except that the proportion of the concentrate and diluting water was changed as below. The fixer replenisher kit contained 1.5 liters of the fixer concentrate.

| Fixer II | | |
|---|---|---|
| Concentrate II | 18 ml | Total 72 ml |
| Water | 54 ml | |
| pH 5.0 | | |

Equivalent results were obtained with fixer concentrate II. Daily maintenance burden on the operator was significantly mitigated.

It is to be noted that in Examples 1 and 2, the operation was repeated using a similar developer but containing 2 g/l of disodium EDTA dihydrate as a chelating agent. This chelating agent could not suppress the influence of iron dissolved in the developer, the developer became unstable, and no consistent development was achieved during continuous operation.

According to the present invention, photosensitive material is continuously processed in a reduced replenishment mode over a prolonged period of time, during which both replenisher reservoir fixer become empty at the same interval so that the operation of reservoir replacement is simple. There is little chance that only one replenisher reservoir is replaced, but the other one is left unchanged.

Although some preferred embodiments have been described, many modifications and variations may be made thereto in the light of the above teachings. It is therefore to be understood that within the scope of the appended claims, the invention may be practiced otherwise than as specifically described.

I claim:

1. In a method for processing a photographic silver halide photosensitive material through an automatic processor having a developing tank filled with a developer and a fixing tank filled with a fixer, comprising the steps of:

passing the photosensitive material through the developing tank for development and then through the fixing tank for fixation, and supplying developer and fixer replenishers to the developing and fixing tanks in amounts corresponding to the quantity of the photosensitive material processed, respectively, the improvement comprising adding at least one chelating agent to the developer and the developer replenisher, furnishing a developing package unit having received therein a replenisher concentrate from which the developer replenisher is prepared, and preparing the developing replenisher by diluting the replenisher concentrate in the developing package unit with water to a total volume of Pd ml, furnishing a fixing package unit having received therein a replenisher concentrate from which the fixer replenisher is prepared, and preparing the fixer replenisher by diluting the replenisher concentrate in the fixing package unit with water to a total volume of Pf ml, supplying the developer replenisher in an amount (Rep)d of up to 450 ml per unit area (1 $m^2$) of the photosensitive material, and supplying the fixer replenisher in an amount (Rep)f of up to 500 ml per unit area (1 $m^2$) of the photosensitive material, wherein (Rep)f/()Rep)d is equal to Pf/Pd to within±5% so that the developer concentrate and fixer concentrate are consumed and replaced substantially at the same time, and (Rep)f/(Rep)d is within the range of from 0.7 to 1.5.

2. The method of claim 1 wherein the developer in the developing tank has a volume of Td ml, the fixer in the fixing tank has a volume of Yf ml, and Td/Tf is equal to Pd/Pf to within±5%.

3. The method of claim 1 wherein the chelating agent has a stability constant of at least 8 relative to ferric ion.

4. The method of claim 3 wherein the chelating agent is selected from the group consisting of an organic carboxylic acid chelating agent, an organic and inorganic phosphoric acid chelating agent, and a polyhydroxy compound.

5. The method of claim 3 wherein the chelating agent is added to the developer in an amount of 0.01 to 50 grams per liter of the developer.

6. The method of claim 1 wherein the photosensitive material is a black-and-white photosensitive material and the developer is a black-and-white developer.

7. The method of claim 1 wherein (Rep)f/(Rep)d falls within the range of from 0.75 to 1.35.

8. The method of claim 1 wherein the developer contains 0.05 to 10 parts by weight of iron calculated as Fe per million parts by weight of the developer in running equilibrium state.

9. The method of claim 1 wherein the photographic silver halide photosensitive material has a silver coating weight of up to 3.5 grams per square meter.

* * * * *

UNITED STATES PATENT AND TRADEMARK OFFICE

CERTIFICATE OF CORRECTION

PATENT NO. : 5,178,994
DATED : 01/12/93
INVENTOR(S) : Minoru Yamada

It is certified that error appears in the above-indentified patent and that said Letters Patent is hereby corrected as shown below:

Claim 1, at column 23, line 10, delete "0Rep)d" and insert --(Rep)d--.

Claim 2, at column 23, line 17, delete "Yf" and insert --Tf--.

Signed and Sealed this

Twenty-second Day of March, 1994

*Attest:*

*Attesting Officer*

BRUCE LEHMAN

*Commissioner of Patents and Trademarks*